United States Patent [19]

Meier

[11] 4,066,293

[45] Jan. 3, 1978

[54] ADJUSTABLE CARRIER APPARATUS TO DEFINE FURNITURE OR THE LIKE

[75] Inventor: Heinz Meier, Pacific Palisades, Calif.

[73] Assignee: Landes Manufacturing Company, Los Angeles, Calif.

[21] Appl. No.: 694,179

[22] Filed: June 9, 1976

[51] Int. Cl.[2] ..... A47C 3/00

[52] U.S. Cl. ..... 297/325

[58] Field of Search ..... 297/130, 118, 325–329, 297/313, 457, 440

[56] References Cited

U.S. PATENT DOCUMENTS

| | | | |
|---|---|---|---|
| 321,230 | 6/1885 | Lewis | 297/118 X |
| 326,241 | 9/1885 | Preston | 297/1 X |
| 2,232,985 | 2/1941 | Weaver | 297/325 X |
| 2,740,465 | 4/1956 | Mugler | 297/325 X |
| 2,749,971 | 6/1956 | Ehrman | 297/325 X |

FOREIGN PATENT DOCUMENTS

| | | | |
|---|---|---|---|
| 586,278 | 10/1933 | Germany | 297/130 |
| 809,549 | 2/1959 | United Kingdom | 297/325 |

*Primary Examiner*—Francis K. Zugel
*Attorney, Agent, or Firm*—William W. Haefliger

[57] ABSTRACT

An adjustable carrier comprises:

a. a carrier frame, and b. a rotary support including two integrally interconnected rotors removably supporting the frame in a first frame position relative to the support, c. the frame including a stabilizing portion projecting in spaced relation from the rotary support in each of said positions.

The frame and rotary support may, for example, define a chaise lounge or a chair.

1 Claim, 9 Drawing Figures

ADJUSTABLE CARRIER APPARATUS TO DEFINE FURNITURE OR THE LIKE

BACKGROUND OF THE INVENTION

This invention relates generally to adjustable carrier apparatus, and more particularly concerns apparatus defining a very simple adjustable combination of a carrier frame and rotary support. Such apparatus is especially adapted to incorporation in furniture design, as for example chairs and chaise longues. While the invention will be described in relation to the latter, it will be understood as having wide applications.

There is a continuing need for furniture such as chairs characterized by low-cost, lightweight, simple construction. There is also a need for chairs which have different seating elevations and different backrest recline elevations. Insofar as I am aware, there is no previous chair combining most or all of these features, in the unusually advantageous manner as is now provided by the invention. As will be seen, the chair requires no hinges, yet achieves different seating elevations and backrest recline angles, in a simple, two-piece design.

SUMMARY OF THE INVENTION

It is a major object of the invention to provide adjustable carriage apparatus, as for example a chair or chaise longue, embodying advantages and features mentioned above, as well as others that will appear. Basically, the apparatus comprises:

a. a carrier frame, and
b. a rotary support including two integrally interconnected rotors removably supporting the frame in a first frame position relative to the support,
c. the frame including a stabilizing portion projecting in spaced relation from the rotary support in each of said positions.

Further, the frame may have an alternate or second position relative to the rotary support, the two frame positions typically being at different elevations; such two elevations may be characterized by different seat elevations and backrest inclinations in the base of a chaise longue; the rotors or wheels may be integrally interconnected by cross tie members (as for example three such members) providing shoulders to removably support the frame; and hook means may be provided on the frame to selectively engage the cross tie members in different configurations, to block rotor rotation, as will be described.

These and other objects and advantages of the invention, as well as the details of an illustrative embodiment, will be more fully understood from the following description and drawings, in which:

DRAWING DESCRIPTION

DETAILED DESCRIPTION

Figure 1:
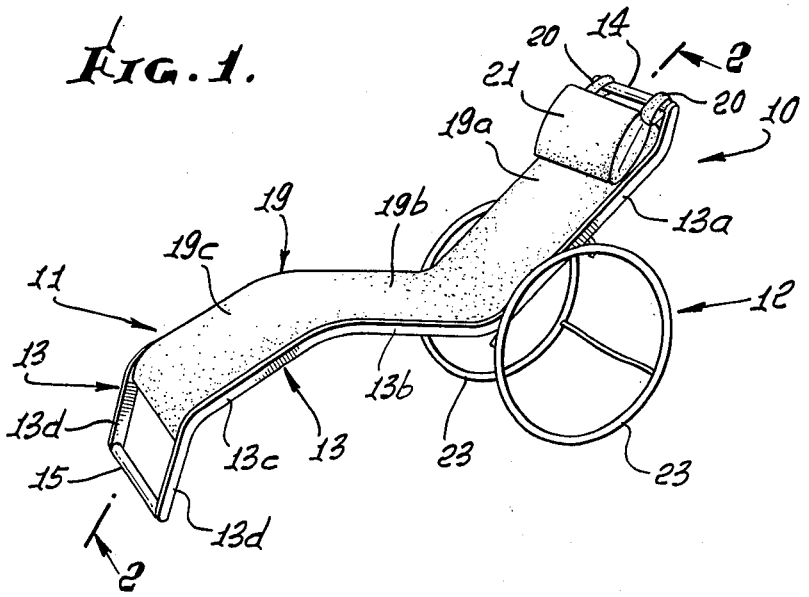
FIG. 1 is a perspective showing of a chaise longue embodying the invention.
Figure 2:
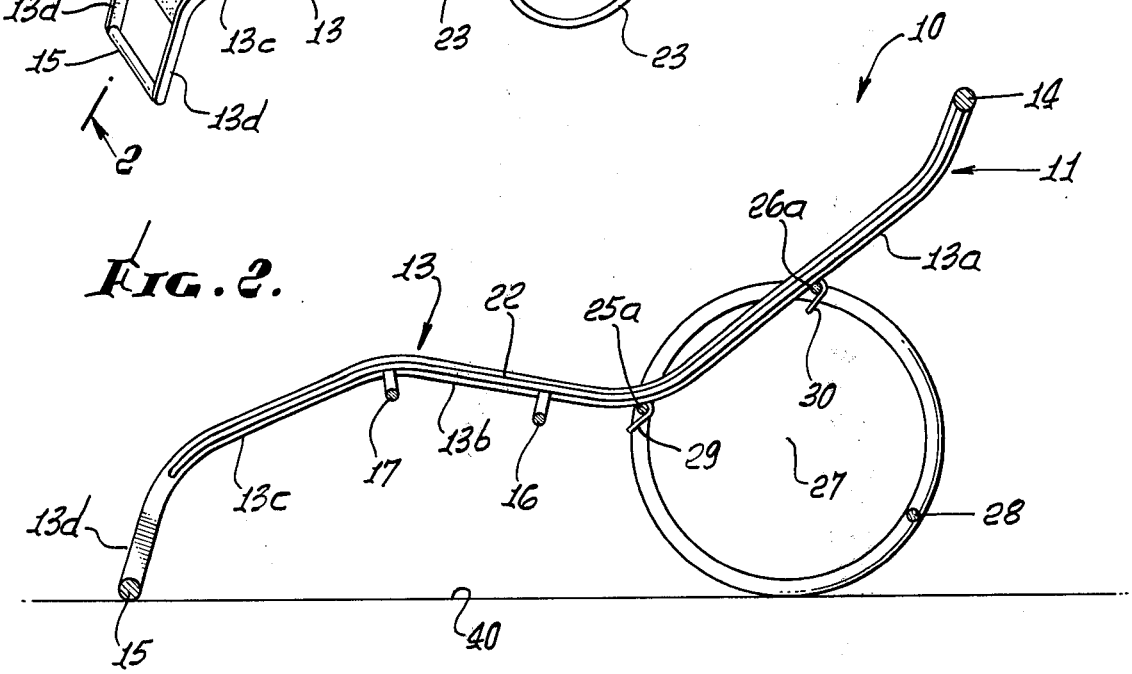
FIG. 2 is a side elevation, taken in section, of the chaise longue of FIG. 1.
Figure 3:
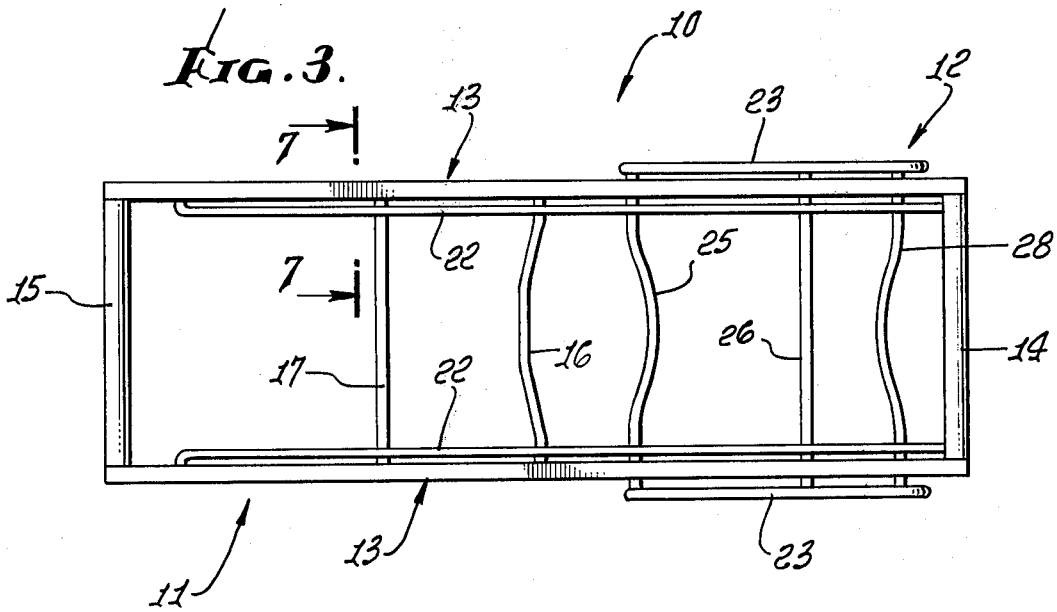
FIG. 3 is a top plan view of FIG. 2; without certain sling structure.

In FIGS. 1–3, an adjustable carrier 10 has the form of furniture such as a chaise longue. The carrier includes a frame 11 and a rotary support 12 removably supporting the frame in a first stable frame position relative to the support 12.

The frame 11 may be endwise elongated and include two like side members 13 each having sections **13*a*–13*d*, and cross members 14–17. The cross members may comprise light weight metallic tubes, member 14 interconnecting side sections 13*a* and member 15 interconnecting side sections 13*d*. Also member 16 interconnects side sections 13*b* and member 17 interconnects side sections 13*c*** at a knee location. The side members and sections may consist of metallic bars, curved and angled as shown.

Figure 7:
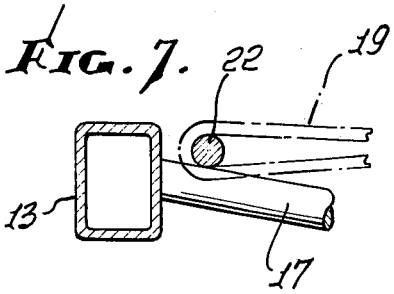
FIG. 7 is a section on lines 7—7 of FIG. 3.

A flexible fabric sling 19 is carried by the frame to extend between the side members 13 and to follow the contour of sections **13*a*–13*e*. Thus, the sling provides a backrest at 19*a*, a seat at 19*b* and a leg rest at 19*c*. A back rest portion of the frame may include the members 13*a*. The sling, at its sides, is wrapped around the side rails 22 which follow the contours of the members 13, at the inner sides thereof. End straps 20 may loop over cross-member 14 to support a head rest 21. FIG. 7 shows side rail 22 supporting the sling and supported by cross-member 17 and side member 13**. Other methods of supporting the sling on the frame may be employed.

The rotary support 12 may include two laterally spaced and interconnected rotors such as wheels 23 which extend upright. The rotors have laterally projecting shoulders to removably support the frame in each frame position, as for example the relatively raised position of the frame in FIG. 2, and the relatively lowered position of the frame in FIG. 4. Such shoulders may include first shoulders **25*a* defined by a first tie member 25 interconnecting the rotors, and second shoulders 26*a* defined by a second tie member 26 interconnecting the rotors. The curved tie members 25 and 26 extend laterally between the rotors and at angularly spaced locations about a common axis 27 of rotation defined by the two rotors. A third tie member 28 also extends between the rotors or wheels, at a third location angularly spaced about axis 27 from members 25 and 26**. Accordingly, the rotors or wheels are relatively rigidly interconnected at three tie locations, to maintain them in parallel upright condition; at the same time, the rotors and tie members define a lightweight metallic support which can be easily rolled about for storage or for shifting its position in a room.

The frame carries interengagement or hook means located to selectively engage the tie members, as for example the first and second shoulders **25*a* and 26*a*. For example, the hook means may include primary laterally spaced hooks 29, and secondary laterally spaced hooks 30, the latter longitudinally spaced from the former, along the frame and depending from the frame side members 13. FIG. 2 shows hooks 29 selectively engaging shoulders 25*a*, and hooks 30 selectively engaging shoulders 26*a*, the frame there being supported in relatively high position. Contrast with this the relatively lower frame position in FIG. 4, with hooks 30 selectively engaging shoulders 25***a* on tie member 25, and hooks 29 free of engagement with any shoulders.

Figure 4:
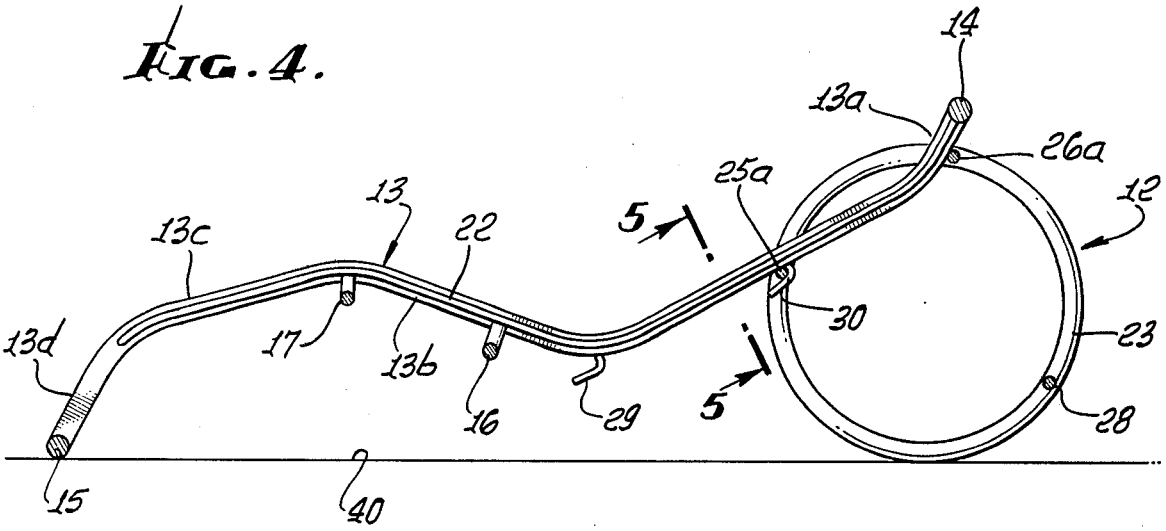
FIG. 4 is a side elevation, taken in section, of the chaise longue in another position.
Figure 5:
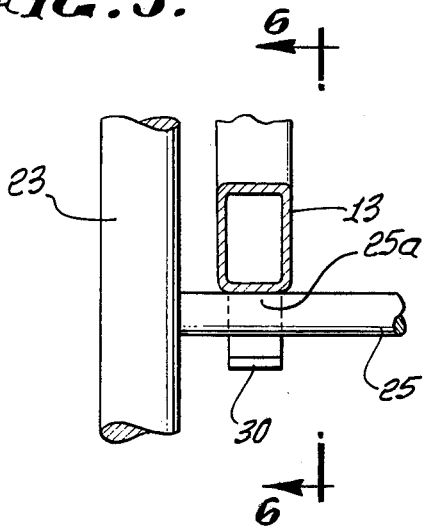
FIG. 5 is a section on lines 5—5 of FIG. 4.
Figure 6:
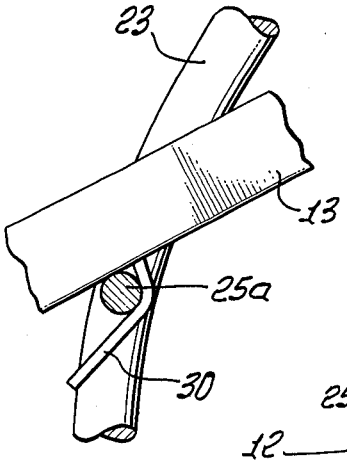
FIG. 6 is a side elevation, in section, on lines 6—6 of FIG. 5.
Figure 9:
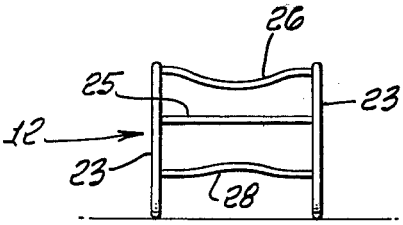
FIG. 9 is an end elevation showing two supports and a tie member.

The rotors are prevented from rotating in FIG. 2 by virtue of the fact that both hooks 29 and 30 engage the respective shoulders 25*a* and 26*a;* and the rotors are prevented from rotating counterclockwise in FIG. 4 by virtue of the fact that hooks 30 engage shoulders 25*a* and the shoulders 26*a* engage and are blocked by the frame side member sections 13*a,* as shown. If desired, the rotors may be rotated to cause the tie members 26 to interfit hooks 30, and the tie member 28 to engage the frame side member sections 13*a,* to achieve a still lower frame position. Note in this regard that the spacing of tie member 28 from tie member 26 is greater than the spacing of tie member 26 from tie member 25.

A stabilizing portion of the frame, as for example leg sections 13*d,* projects in remotely spaced relation from the rotors support 12, in each position of the frame, to engage the floor 40, as shown. The back rest portion of the frame is shown as substantially entirely supported on the rotors in each of the FIG. 2 and FIG. 4 positions of the frame, for example.

Figure 8:
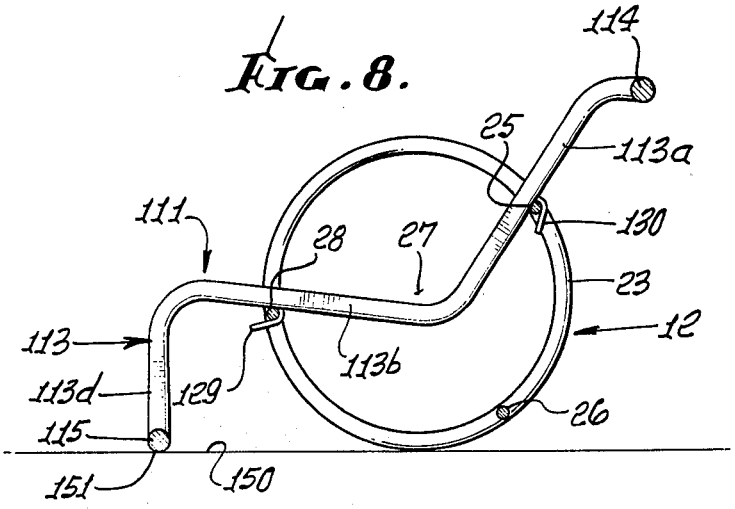
FIG. 8 is a side elevation, taken in section, of a chair embodying the invention.

In FIG. 8, the rotary support 12 is similar to that in FIGS. 1–7, with two wheels 23 and cross tie members 25, 26 and 28. The frame 111 is modified somewhat, i.e. reduced in length to form a chair. The frame includes side members 113 as before, each including back sections 113*a,* seat section 113*b* and end support "leg" 113*d.* Depending hooks 129 and 130 on each frame side member 13 engage the cross tie members 28 and 25, to support the frame on the wheels. The frame leg 113*d* provides the stabilizing portion that projects in spaced relation to the rotary support 12, and engages the ground 150 at 151. Note the provision of frame cross-members at 114 and 115, member 115 integral with leg sections 113*d.*

Rotors 12 may consist of other materials, such as wood or heavy metal.

I claim:

1. In adjustable carrier apparatus a. a carrier frame, and b. a rotary support including two integrally interconnected upright wheels supporting the frame in a first frame position relative to the support, the frame having a second and alternate position relative to the rotary support, in which the rotary support supports the frame, c. the frame including a stabilizing portion having a seat and a ground engaging portion projecting in forwardly spaced relation from the rotary support in each of said positions, and d. the frame having a backrest portion which is substantially entirely supported on the rotary support in each of said first and second positions, the support of the frame by the rotary support blocking rotation of the support in each of the two frame positions, e. the rotary support including multiple members connected only to peripheral portions of the wheels and extending laterally therebetween, the wheels being centrally open, said members angularly and sequentially spaced about a common axis of rotation defined by said wheels, f. said backrest portion directly overlying and supported by two of said members in each of said frame positions, g. said frame including hooks to engage said members, said hooks including primary laterally spaced hooks and secondary laterally spaced hooks, said primary hooks longitudinally spaced along the frame from said secondary hooks.

* * * * *